United States Patent [19]

Bovet

[11] 4,180,112

[45] Dec. 25, 1979

[54] BEACH BAG

[76] Inventor: Thomas Bovet, 221-226 Gloucester Rd., 13th Floor, Hyde Centre, Wanchai, Hong Kong

[21] Appl. No.: 2,169

[22] Filed: Jan. 10, 1979

[30] Foreign Application Priority Data

Oct. 18, 1978 [DE] Fed. Rep. of Germany ... 7831317[U]

[51] Int. Cl.[2] ..... A45C 3/10

[52] U.S. Cl. ..... 150/1.7; 135/5 R; 190/1

[58] Field of Search ..... 150/28 R, 33, 1.7, 49; 190/1, 2, 42; 135/5 R, 7.1 R

[56] References Cited

U.S. PATENT DOCUMENTS

| | | | |
|---|---|---|---|
| 2,543,597 | 2/1951 | Peery | 135/7.1 R |
| 2,819,776 | 1/1958 | Balsam | 135/5 R X |
| 2,853,086 | 9/1958 | Biagosch | 135/5 R |
| 3,651,847 | 3/1972 | Casamassima | 190/1 X |

*Primary Examiner*—Donald F. Norton

*Attorney, Agent, or Firm*—Pollock, Vande Sande & Priddy

[57] ABSTRACT

A beach or like bag which can be used to accommodate articles to be carried and can be opened out to provide a shield to give protection from, for example, the sun or wind. The bag has side panels joined along their sides and bottom and open at the top and carrying handles attached to the side panels. Releasable closure means are provided for one side and the bottom of the side panels. The other side is stiffened. A triangular flap has two of its edges joined to respective bottom edges of the side panels. An L-shaped reinforcing member reinforces each edge of the side panels which has the releasable closure means, the L-shaped members also stiffening parts of the third edge of the triangular flap. When the closure means are closed the bag functions as a bag. When they are released the bag can be opened out with the side panels forming upright shields and the triangular flap providing a cover extending between the two upright shields.

5 Claims, 3 Drawing Figures

18
16
32
34
14
10
28
12
20
19
30
20
29
24
26

BEACH BAG

This invention relates to bags.

BACKGROUND TO THE INVENTION

When sitting or laying on the beach it is often desirable to provide some sort of protection from sun, wind and/or sand thrown up from the feet of passers-by. Normally this is achieved by taking to the beach a separate wind break or other shield.

Known beach bags consist of a rectangular or other shaped carrying container having an open top to enable one to place items into the bag and carrying handles attached to the side panels of the bag for holding the bag. An object of this invention is to provide such a bag which can additionally function to give the protection noted above.

BRIEF SUMMARY OF THE INVENTION

According to the invention there is proprovided a bag comprising side panels joined along their side edges and bottom edge and open at the top, carrying handles attached to the side panels, releasable closure means for one side edge and the bottom edge of the side panels, the closure means closing the said one side edges and the bottom edges when the bag is to function as a bag and being capable of being released when the bag is to function as a shield, stiffening means for the other side edges of the panels, a triangular flap two edges of which are joined to respective bottom edges of the side panels, and an L-shaped reinforcing member for each said one said edge of the side panels of the bag, one arm of the member stiffening its respective one side edge of the panel of the bag and the other arm stiffening a part of the remaining edge of the triangular flap.

Such an arrangement can be very simple yet will function well both as a shield and as a bag. Thus when the closure means are unfastened the bag can be opened about the said other side edge to provide a shield, the triangular flap being held substantially flat by the said other arms of the L-shaped reinforcing members.

The triangular flap will be in the shape of an isosceles triangle with the equal edges joined to the bottom edges of the side panels and preferably the flap is arranged to fold about the line which is at right angles to the base and extends to the apex of the triangle and the lines which extend to that line and bisect the two nonapex angles. When the triangular flap is folded in this way the flap does not intrude significantly into the storage or carrying space in the bag when the closure means are fastened.

The closure means are desirably constituted by a zip fastener but can also be constituted by a fabric zip, press studs or the like.

The stiffening means and the L-shaped reinforcing members can, for example, be metal rods or tubes accommodated in elongated pockets formed in the material of the bag.

BRIEF DESCRIPTION OF THE DRAWINGS

An example of a bag according to the invention will now be described with reference to the accompanying drawings, in which.

DESCRIPTION OF THE PREFERRED EMBODIMENT

Figure 1:
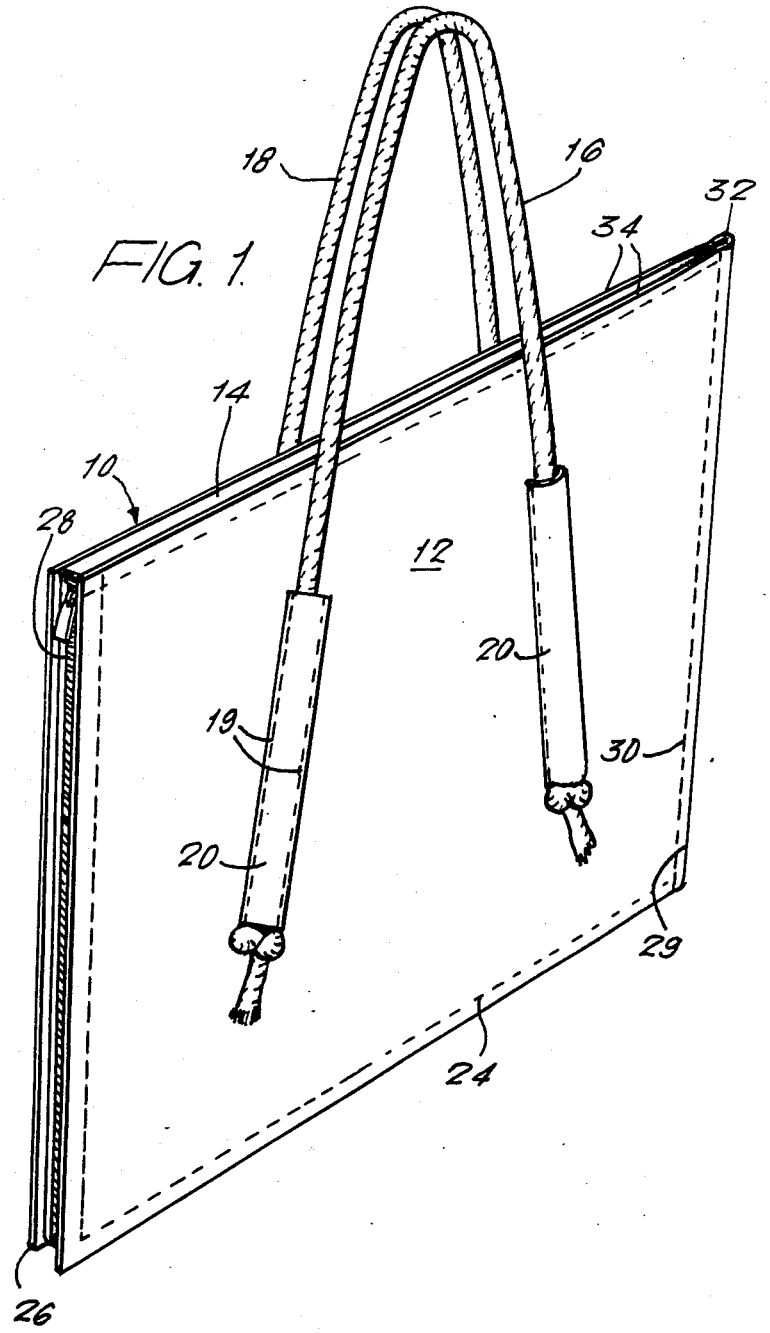
FIG. 1 is a perspective view of the bag in the carrying position.

The bag 10 shown in the drawings and in particular FIG. 1 is formed of side panels 12 and 14 and carrying handles 16 and 18 attached respectively to each side panel. The panels can be formed of any suitable material such as cloth or plastics sheeting. Preferably they are however formed of canvas. The handles 16 and 18 are conveniently formed of lengths of rope passing through tubes formed by stitching along lines 19 pieces 20 of canvas to the panels 12 and 14, the ends of the rope being knotted to retain them in the tubes.

The side panels 12 and 14 are joined along the bottom 24 and one side edge 26 (the left hand edge as viewed in FIG. 1) by a zip fastener 28. They are joined along their other side edge 29, by a line of stitching 30. The line of stitching 30 defines an elongated pocket 32 in which a length of metal rod or tube (not visible) is accommodated to stiffen that edge 29.

The panels are not joined along their top edges 34 which remain open so that items can be placed into the bag.

Figure 2:
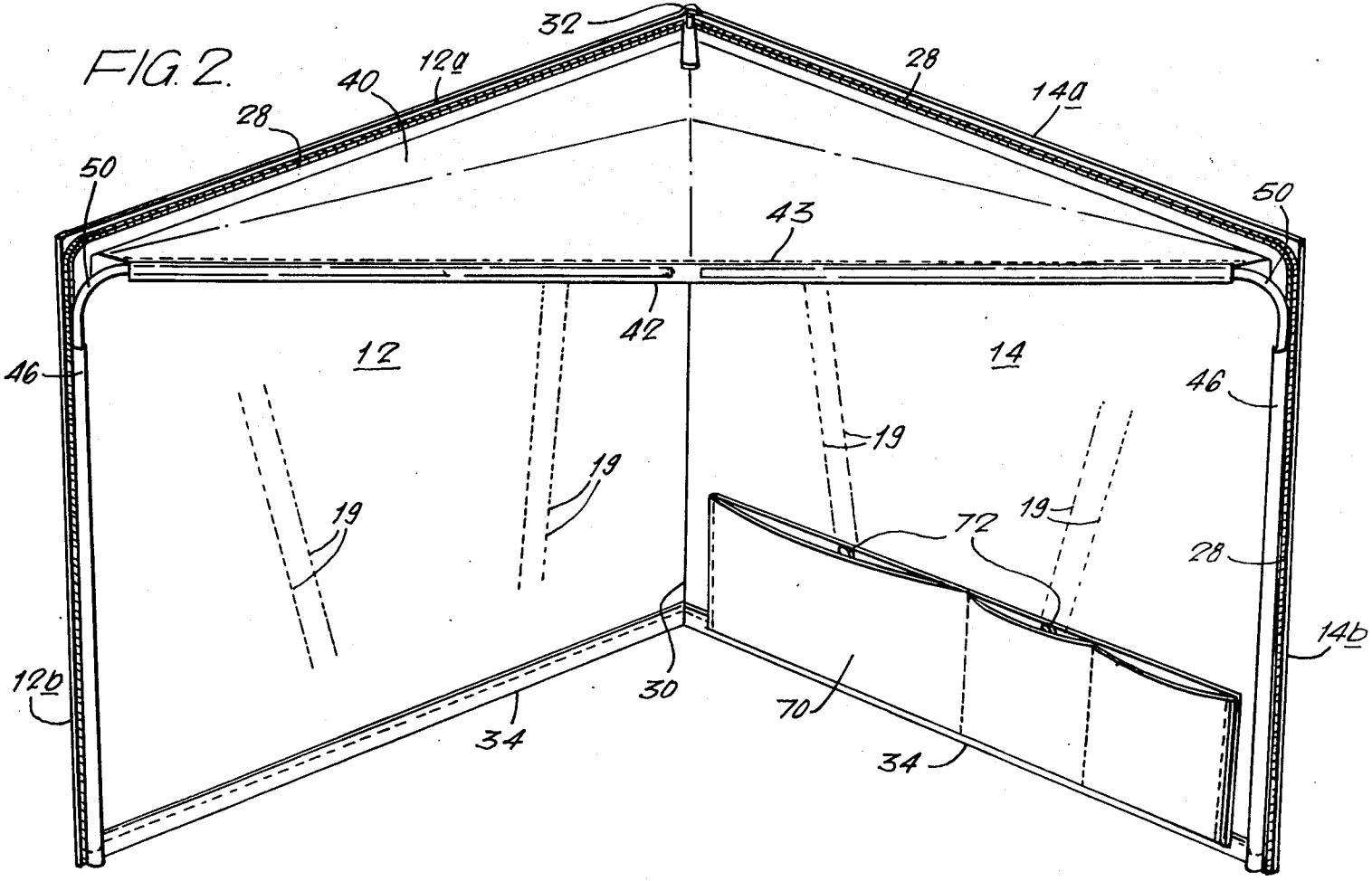
FIG. 2 is a perspective view of the bag opened out into the form of a shield.
Figure 3:
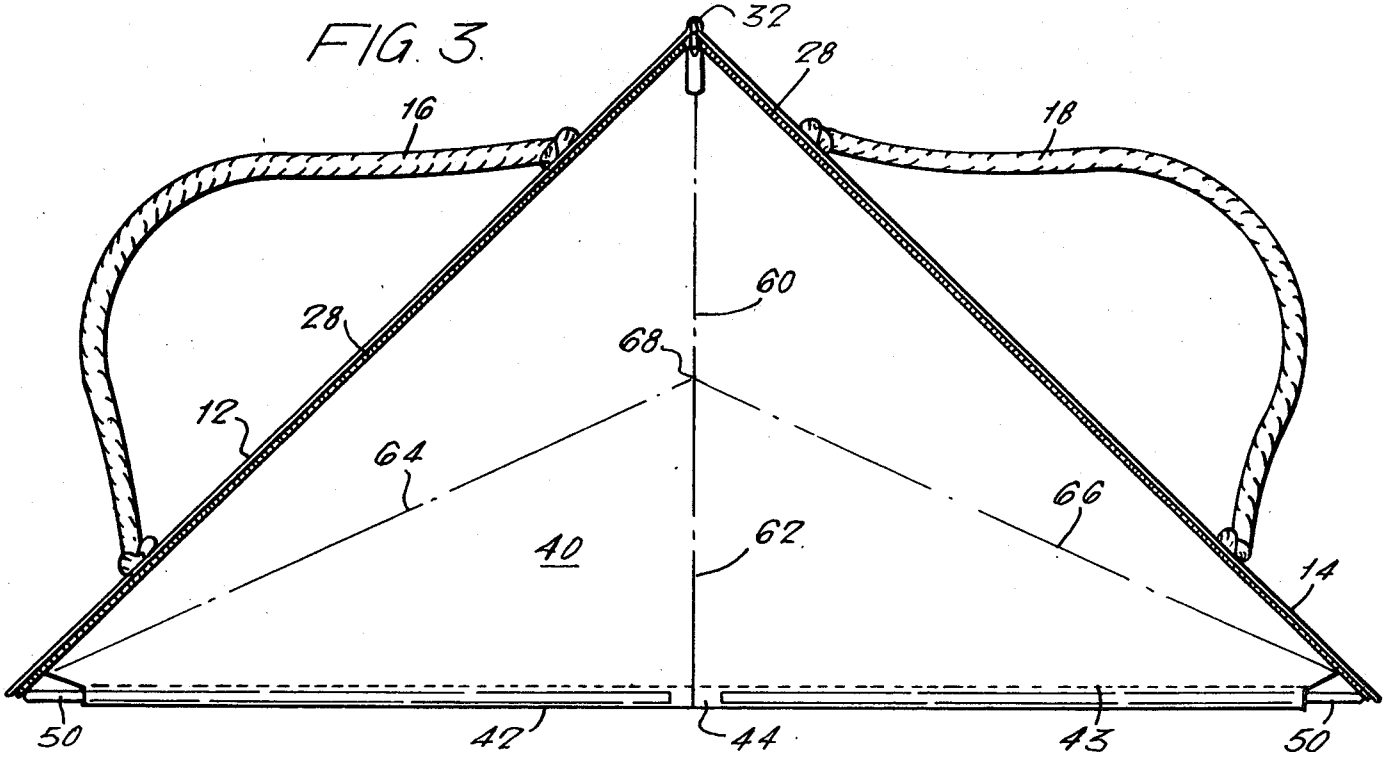
FIG. 3 is a plan view of the bag in the opened configuration shown in FIG. 2.

Referring now to FIGS. 2 and 3 which show the bag 10 in use as a shield, a triangular flap 40 is provided, the flap being made of, for example, similar material to the material of the side panels 12 and 14 or as in the embodiment shown in the drawings of transparent plastics material. The flap is in the shape of an isosceles triangle, its two edges of equal length being joined by stitching to the bottom edges **12*a* and 14*a* of the panels 12 and 14, respectively, which form the bottom 24 in the closed bag. The remaining edge 42 of the flap is folded over and stitched with a line of stitching 43 to form an elongated tube 44**.

As best shown in FIG. 2, an elongated pocket 46 is formed in the fabric along each side edge **12*b* and 14*b* of the panels 12 and 14, respectively, which form the side edge 26 in the closed bag. These pockets are open at one end and one arm of an L-shaped reinforcing metal rod or tube 50 extends into them. The other arms of the rods 50 extend into respective ends of the tube 44 formed along the remaining edge 42** of the flap, so supporting that edge and holding the flap open and substantially flat when the bag is used as a shield.

The flap is preferably folded when the bag is in its carrying configuration along fold lines 60, 62, 64 and 66. The lines 60 and 62 are an extension of one another and are formed by the bisector of the apex angle of the flap, the line 62 joining the edge 42 at right angles, whilst the lines 64 and 66 are the bisectors of the other angles of the triangular flap. The folding is effected so that the mid point 68 of the triangular flap moves downwardly in the sense as shown in FIGS. 2 and 3.

A pocket 70 is shown attached by press studs 72 to the inside of the panel 14 in FIG. 2. This is to accommodate items when the bag is used as a shield. The pocket 70 can be inverted for use when the bag is used in the carrying configuration.

When the bag is used in its carrying configuration the edges 24 and 26 are closed by means of the zip fastener and the flap is folded up from the bottom 24 inside the bag. Additionally the metal rod or tube along the edge 29 and the arms of the rods or tubes 50 extends along the edge 26 and at least part-way along the bottom 24 so holding to keep the bag 10 to shape.

To use the bag as a shield, the zip fastener 28 is undone and the edges 12*b* and 14*b* opened out to open out the flap 40. The rod or tube along the edge 29 and the rods or tubes 50 then hold the panels 12 and 14 and the flap 40 reasonably flat so forming a shield for a person laying on a beach or other place.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A bag comprising:

side panels each having opposite side edges and bottom edges, said panels being joined along said side and bottom edges, carrying handles attached to said side panels, releasable closure means for one side edge and said bottom edge of said side panels, said closure means closing the said one side edges and bottom edges of said panels when said bag is to function as a bag and being released when said bag is to function as a shield, stiffening means for said other side edges of said side panels, a triangular flap having three edges, two of said edges being joined to respective bottom edges of said side panels, and an L-shaped reinforcing member for each said one side edge of said side panels, each reinforcing member having two arms, one arm of said member stiffening its respective one edge of said panel and the other arms stiffening a part of said third edge of said triangular flap.

2. A bag according to claim 1 in which said closure means are a zip fastener.

3. A bag according to claim 1 in which said stiffening means and said L-shaped reinforcing members comprise elongated metal members, and further comprising elongated pockets in the material of said bag in which said metal members are accomodated.

4. A bag according to claim 1 in which said triangular flap is of transparent material.

5. A bag according to claim 1 in which said triangular flap is in the shape of an isosceles triangle, said equal edges of said flap being joined to said bottom edges of said side panels, and further comprising a first fold line in said flap which is at right angles to said third edge of said flap and extends to the apex of the triangle, and further fold lines which extend to said first fold line and bisect the non-apex angles of the triangle.

* * * * *